United States Patent [19]

Hope et al.

[11] Patent Number: 4,476,994

[45] Date of Patent: Oct. 16, 1984

[54] LID LATCHING APPARATUS

[75] Inventors: George P. Hope, Lancaster, Pa.; Randy D. Rhodes, Frenchtown, N.J.

[73] Assignee: RCA Corporation, New York, N.Y.

[21] Appl. No.: 484,525

[22] Filed: Apr. 13, 1983

[51] Int. Cl.[3] ..... B65D 45/00

[52] U.S. Cl. ..... 220/318; 220/327; 220/330; 220/331

[58] Field of Search ..... 220/318, 23.83, 23.84, 220/94 R, 323, 324, 325, 327, 330, 331, 333

[56] References Cited

U.S. PATENT DOCUMENTS

| | | | |
|---|---|---|---|
| 1,328,672 | 1/1920 | Hirsohn | 220/330 |
| 2,077,695 | 4/1937 | Horn | 220/327 X |
| 2,485,837 | 10/1949 | Nadelson | 220/331 X |
| 2,966,257 | 12/1960 | Littlejohn | 206/45.13 |
| 3,200,809 | 8/1965 | Suchowolec | 126/92 |
| 3,525,429 | 8/1970 | Vaughn | 220/318 X |
| 3,924,775 | 12/1975 | Andreaggi et al. | 220/96 |
| 4,089,464 | 5/1978 | Teti, Jr. et al. | 220/4 |
| 4,196,821 | 4/1980 | Teti, Jr. et al. | 220/94 |
| 4,291,817 | 9/1981 | Spitzer et al. | 220/327 |

*Primary Examiner*—Steven M. Pollard

*Attorney, Agent, or Firm*—Joseph S. Tripoli; George E. Haas; William Squire

[57] ABSTRACT

A lid is secured to a housing by a lid latching handle assembly. The handle assembly includes a pair of resilient pads which are compressed against the lid when latched. A pair of locking screws with chamfered shoulders are threaded to the housing and engage a corresponding pair of chamfered holes in the handle to wedge and lock the handle in place as the screws are tightened.

8 Claims, 9 Drawing Figures

LID LATCHING APPARATUS

This invention relates to a lid latching apparatus for securing a lid to a housing containing an electrical instrument.

Computers, electrical instruments, and other portable apparatus may be contained within a housing including a lid and a carrying handle. Generally, the lid may be secured by latches which may be difficult to manipulate and also may be unsightly. In one arrangement the handle may be adjustably secured to the housing to serve as a support for the apparatus. In another arrangement the housing may serve as a protective cover and as a support when the instrument is in use. For example, in U.S. Pat. No. 2,966,257 an instrument carrying case is disclosed in which in one orientation the case is secured to a base by means of its handle. In other orientations the handle is employed for securing the case in an instrument operating position.

With repsect to portable computers, the main computer system may be contained in one housing and the keyboard contained within the lid releasably secured to the main computer housing. A carrying handle may be attached to the assembly to assist in its portability. It is desired that this latter assembly comprise as few elements as possible, can be readily diassembled to expose the keyboard, and reassembled with the keyboard and carrying handle in place with a minimum of tools and with optimum ease by an operator.

In accordance with the present invention, a lid latching apparatus includes a housing having a threaded hole concentric about a first axis and a lid member releasably secured to the housing. A lid latching handle locks the lid member to the housing and is employed to carry the housing and the lid in one orientation of the handle. The handle includes one leg portion which overlies the lid and engages the lid when moved to a locking position and a second leg portion generally normal to the one portion and positioned adjacent to a housing side and has an aperture with a conical side wall. The aperture has a second axis parallel to the first axis. The one leg portion includes means which normally offsets the second axis out of alignment with the first axis when the handle is unlocked. A handle locking screw including a shaft passes through the aperture and includes a conical shoulder engaged with the conical side wall and a threaded stud concentric with the shoulder in engagement with the threaded hole, the second leg portion being between the shoulder and the housing. Upon further engagement of the threaded stud with the threaded hole, the shoulder is moved parallel to the first axis tending to align the axes, placing the one leg portion in the lid locking postion. Thus, the handle is wedged in place, securing the lid member to the housing.

Figure 1:
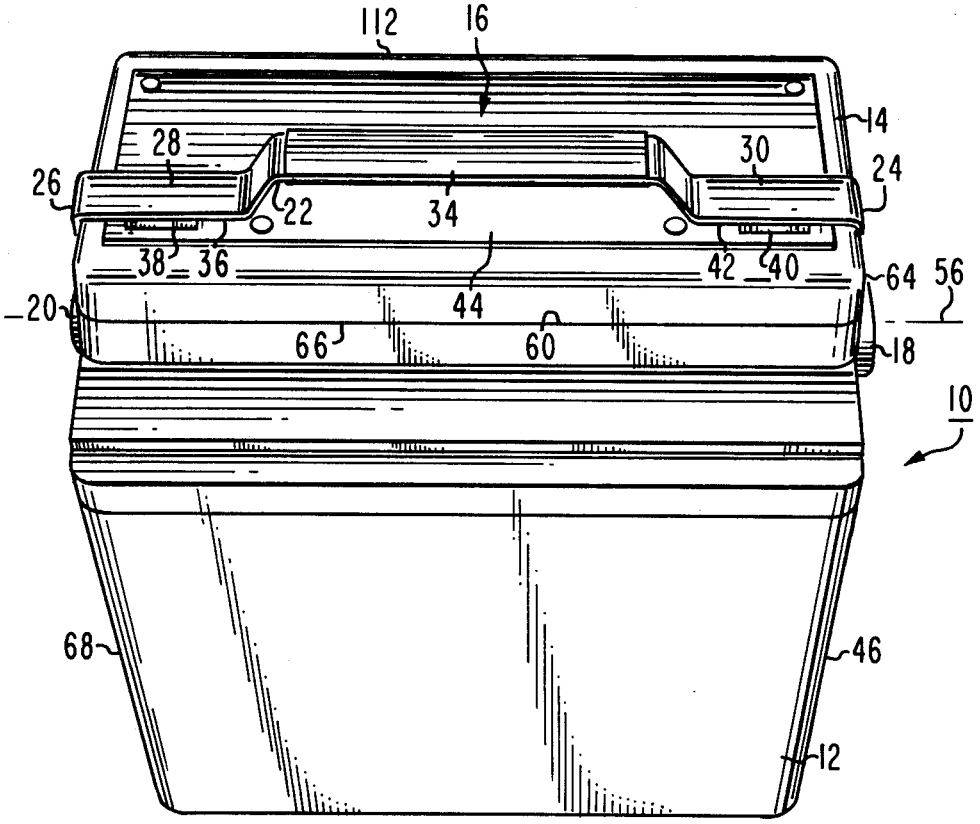
FIG. 1 is a perspective view of an assembly embodying the present invention.
Figures 6, 7, 8:
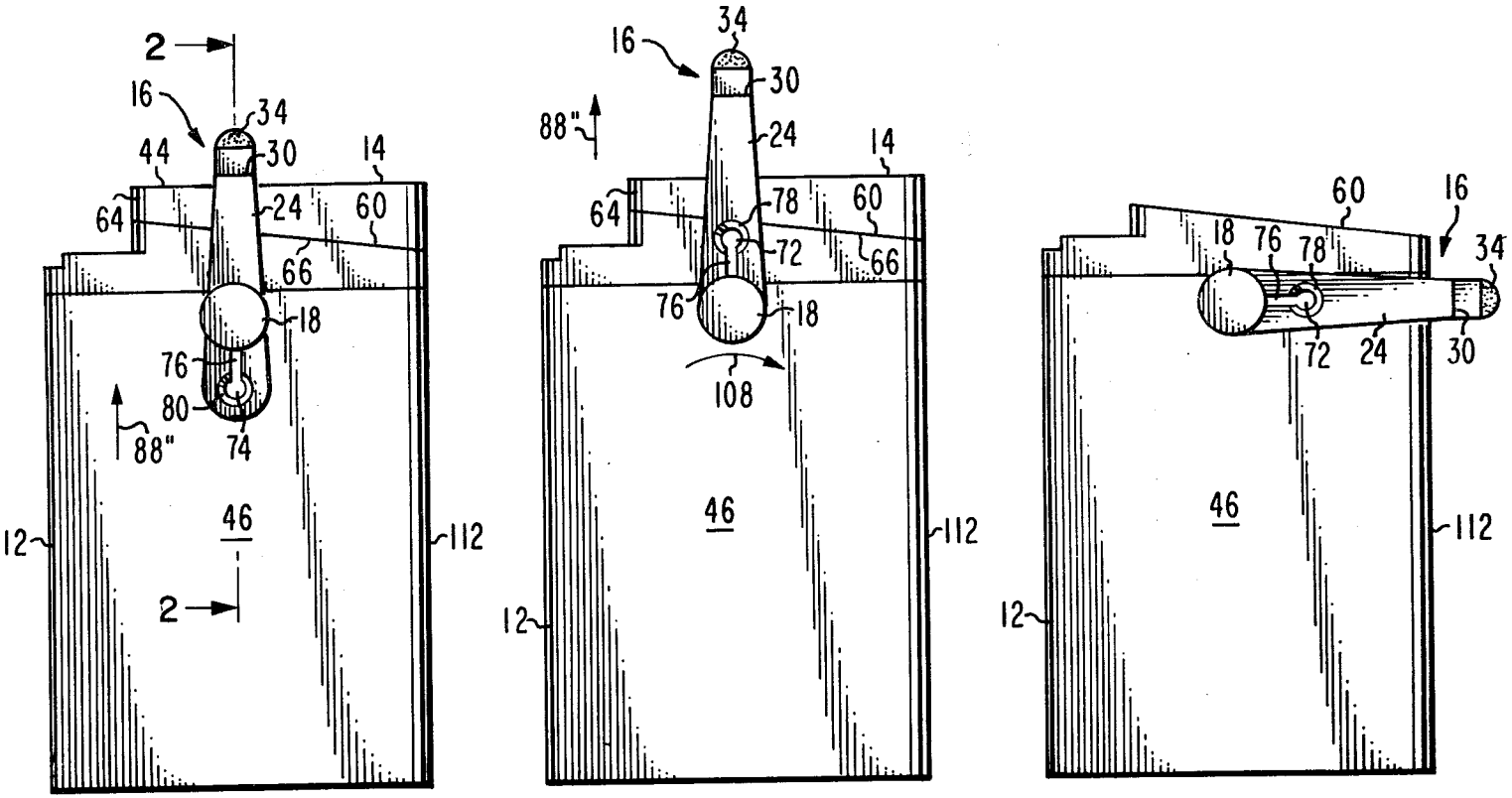
Figure 9:
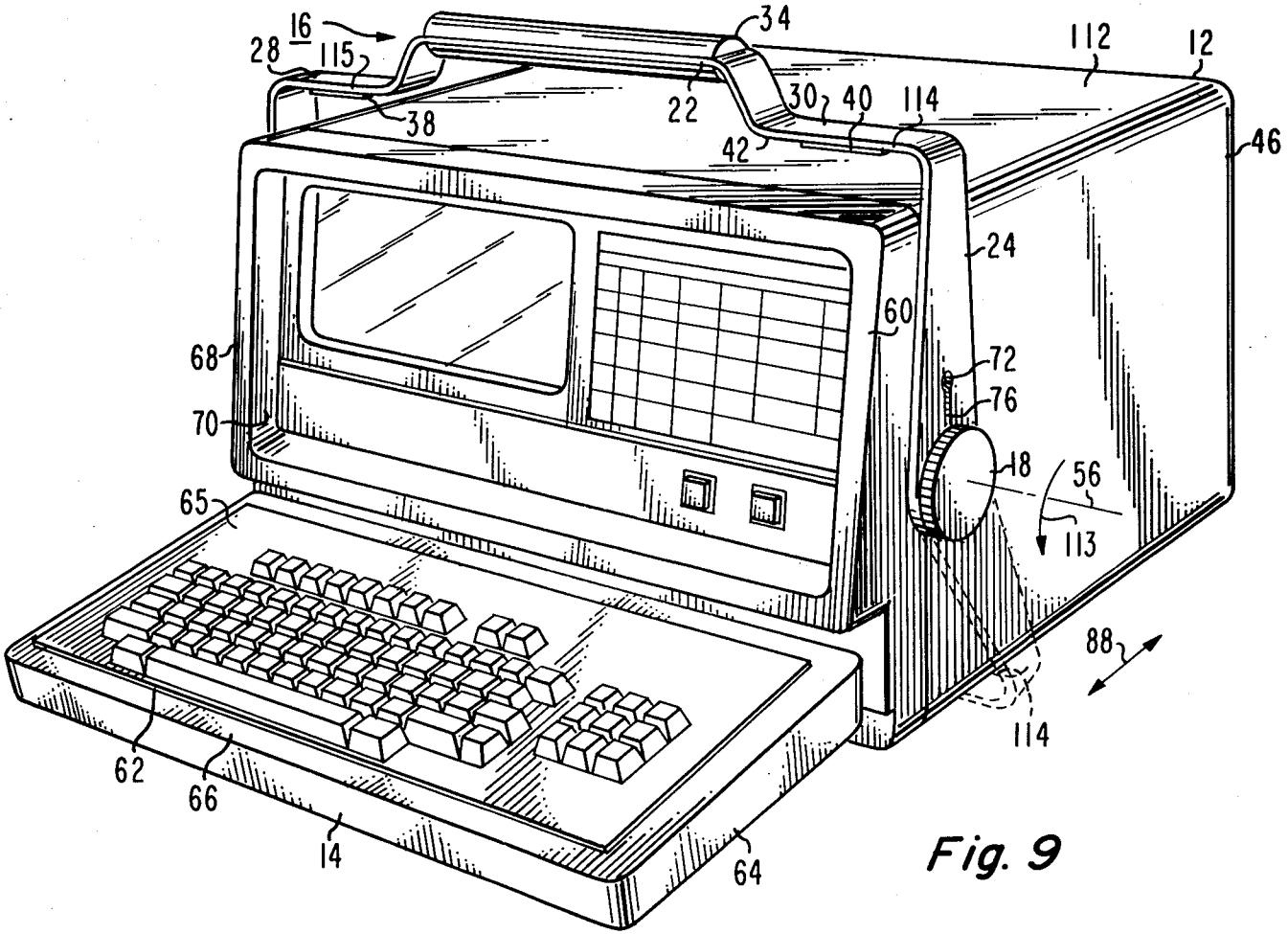

FIGS. 6, 7, and 8 are different side elevation views illustrating different positions of the lid latching handle embodying the present invention; and FIG. 9 is a front perspective view of the embodiment of FIG. 1 with the lid removed.

In FIG. 1 housing assembly 10 includes a base 12, a lid 14, and a handle latching assembly 16 including a handle 22. The base 12 may house electronic equipment, for example, a computer or the like. Lid 14 may contain a keyboard which is to be used in conjunction with a computer in the base 12. Handle 22, as shown in FIG. 1, is oriented in a position which locks the lid 14 to the base 12 and in a position to carry the combined assembly. The handle latching assembly 16 latches the lid 14 to the base 12, tightly securing these two elements together. The handle latching assembly 16 includes two knurled hand screws 18 and 20 on opposite sides of the base 12. The screws may be conveniently loosened by hand. After loosening, the handle 22 may be lifted to release the lid 14. The handle 22 may also be reoriented while loosened without removing it entirely from its secured position to base 12. All of this will become clearer later when the handle latching assembly 16 is explained more fully.

Figure 5:
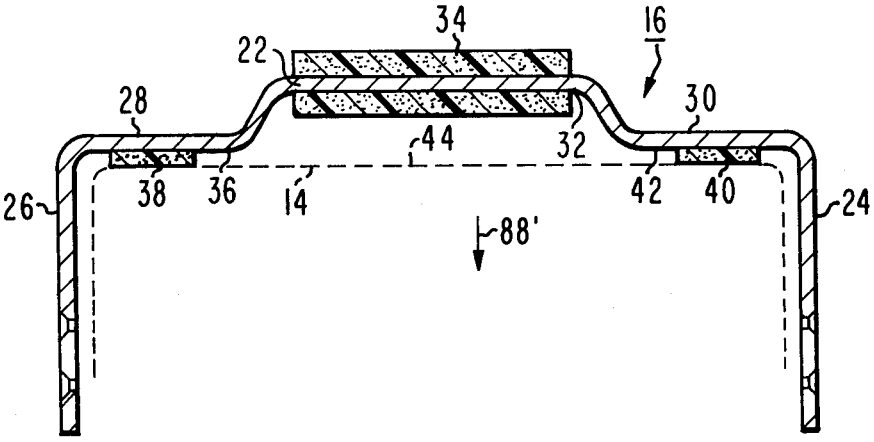
FIG. 5 is a sectional view through the handle of the apparatus of FIG. 1.

In FIG. 5 handle latching assemby 16 includes handle 22 and two legs 24, 26 depending from the handle 22. The handle 22 and legs 24 and 26 may be formed from sheet metal such as aluminum. Handle 22 comprises three portions 28, 30, and 32. Portions 28 and 30 are coplanar. Leg 24 depends at right angles from portion 30. Leg 26 depends at right angles from portion 28. Central portion 32 is offset from portions 28 and 30 to form an opening with lid 14 through which the handle portion 32 may be grasped. A soft resilient handle material 34 may be adherently secured to portion 32 to facilitate appearance and handling. Secured to the under surface 36 of portion 28 is a block 38 of resilient material such as rubber. A similar block 40 of resilient material is secured to the under surface 42 of portion 30. The blocks 38 and 40 abut the upper surface 44 of lid 14 (shown in phantom in FIG. 5) in the lid latching position of assembly 16. When the latching assembly 16 is locked in the lid latching position, FIGS. 1 and 5, the blocks 38 and 40 are resiliently compressed against the lid 14 to secure the lid 14 to the base 12, FIG. 1, without marring the surface of the lid 14. The compression of the blocks 38 and 40 by the handle latching assembly 16 is accomplished with the latching mechanism which will be described below.

Figure 3:
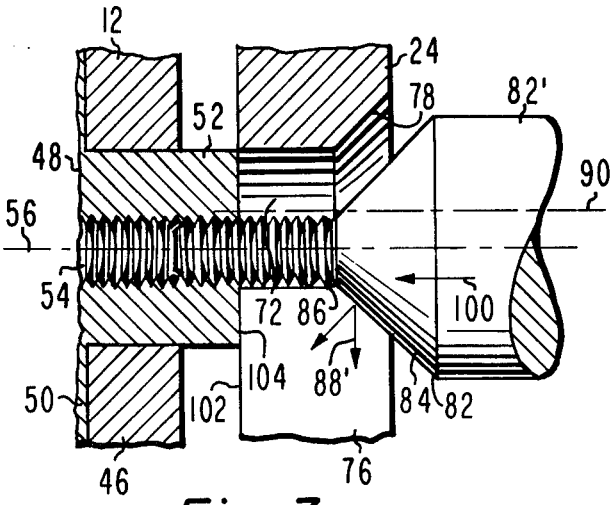
FIG. 3 is a sectional view of a portion of FIG. 2.
Figure 2:
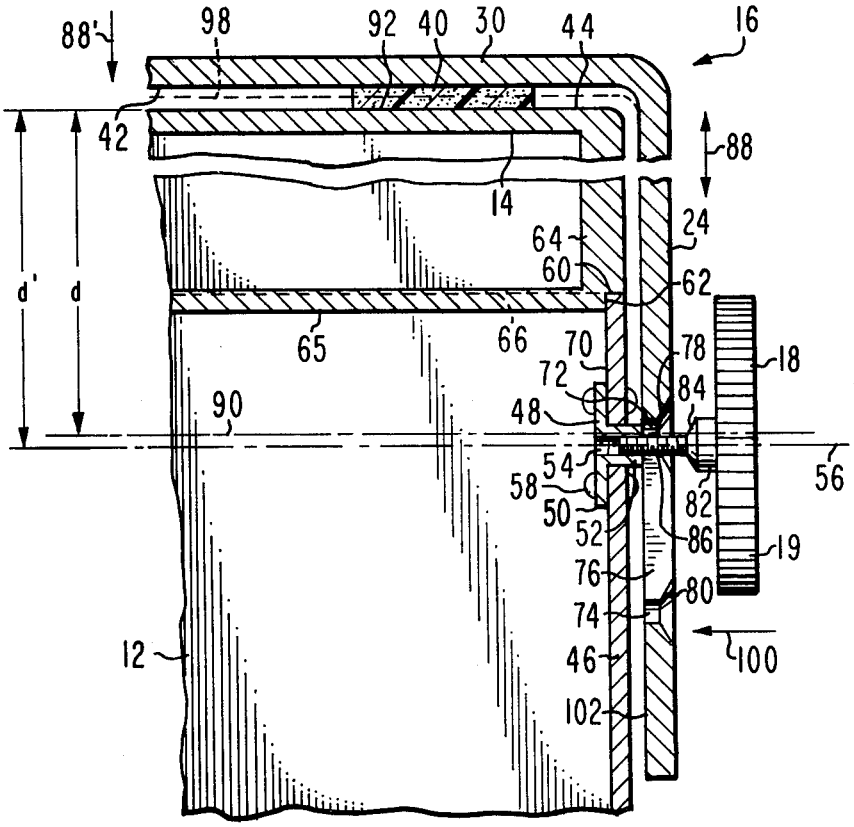
FIG. 2 is a fragmented sectional elevation view through the assembly of FIG. 6 taken along lines 2—2.
Figure 4:
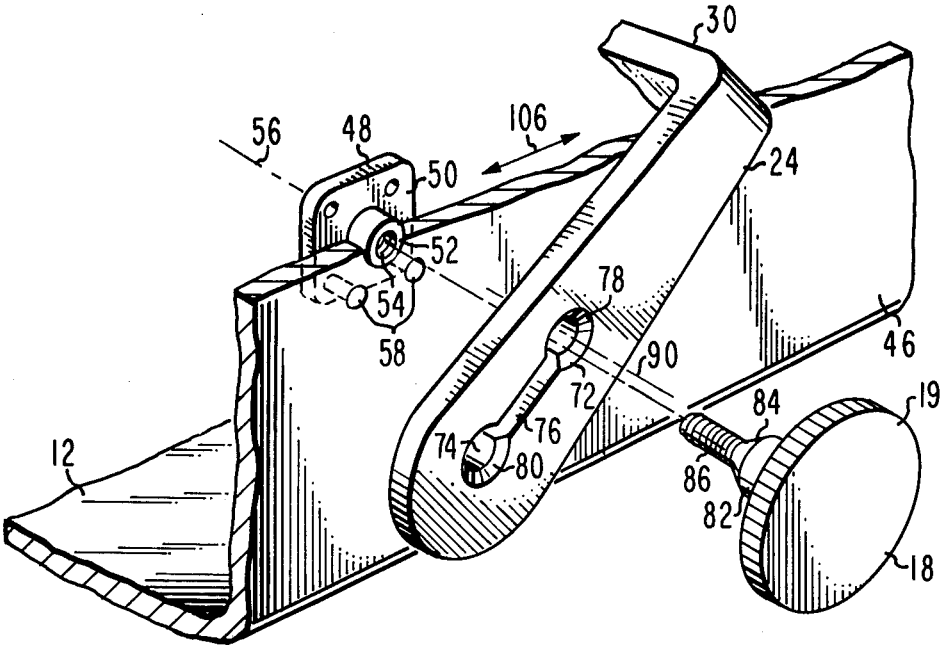
FIG. 4 is an isometric view of a portion of the lid latching apparatus embodying the present invention.

In FIGS. 2, 3, and 4 the base 12 has a side wall 46 to which, in one example, a threaded element 48 is secured. The element 48 comprises a flange 50 and a boss 52. Threaded hole 54 passes through boss 52 and flange 50. The threads of hole 54 are concentric about an axis 56. Element 48 may be secured to the wall 46, by way of example, by rivets or screws 58. In another example, the threaded hole 54 and boss 52 may be integral with side wall 46. The side wall 46 has an upper surface 60.

In FIGS. 1 and 2, the lid 14 has a side wall 64. Side wall 64 has a lower plane surface 66 which abuts upper surface 60 of base 12, wall 46. An element identical to the element 48 is secured to housing side wall 68, FIG. 1, opposite the wall 46 of base 12. The elements 48 on each of the side walls 46 and 68, FIG. 1, are aligned with their axes 56, FIG. 3, (only one axis being shown) coaxial to form a single pivot axis for the lid handle 22.

The leg 24, FIG. 4, has two semicircular holes 72, 74 coupled by and in communication with straight slot 76.

The edges 78, 80 of holes 72 and 74, respectively, are chamfered forming segmented conical surfaces. The chamfered edges 78 and 80 are concentric with the respective holes 72 and 80. Leg 26, FIG. 5, includes two chamfered holes identical to the holes 72 and 74 and edges 78 and 80 spaced identically from each other and in communication with a straight slot identical to slot 76. That is, leg 26 is a mirror image of the leg 24.

In FIGS. 2, 3, and 4 the hand screw 18 includes a knurled disc 19 and circular cylindrical shaft 82 that depends from disc 19. Shaft 82 is formed with a conical surface or conical shoulder section 84 which is spaced from disc 19 by straight section 82'. The shaft 82 includes threaded stud section 86 that depends from the tapered end of conical surface section 84. The conical surface section 84 and threads of stud section 86 are concentric. Threaded stud section 86 mates with the threads of hole 54 in element 48. When stud section 86 engages hole 54, conical surface section 84 is concentric about axis 56. The conical surface of section 84 of shaft 82 selectively mates with and engages the conical edges 78 or 80 of holes 72 and 74, respectively, the stud 86 passing through those holes. The diameter of the threaded stud section 86 is smaller than the width of the slot 76 in leg 24 so the stud may pass within the slot 76 from hole 72 to hole 74 or vice versa. Knurled hand screw 20 on the opposite side of the base 12 is constructed identical to the screw 18.

In FIG. 2, the threaded stud section 86 engages the threads of holes 54, boss 52 in one position so that the conical surface section 84 is located beyond leg 24, as shown. In this position the stud section 86 passes through hole 72 on both sides of leg 24 and is aligned with slot 76. When in this position the leg 24 may be displaced in directions 88.

The center of the hole 72 lies on axis 90. In FIG. 2, the spacing of the under surface 92 of the block 40 of the uncompressed resilient material to the axis 90 is a distance d. This distance is smaller than the distance d' between the lower surface 92 of the block 40 (and of upper surface 44 of lid 14) and the axis 56 of the threaded hole 54 of the element 48. This offset or relative spacing of surface 92 to axes 90 and 56 occures when the handle latching assembly 16 rests on the lid 14, upper surface 44, in the unlatched state. In the latched state, the axis 90 of the hole 72 in leg 24 of the handle latching assembly is aligned coaxial with axis 56 and the resilient block 40 is compressed. When the two axes 90 and 56 are aligned coaxial, the portion 30 of the handle latching assembly 16 is positioned as shown in phantom in FIG. 2 at 98. Thus, conical surface section 84 of screw 18 is wedged against the conical surface of edge 78 of hole 72.

In operation, the threaded stud section 86 of the screw 18 is engaged with the threaded hole 54 of the element 48 as shown in FIG. 2. Threaded stud section 86 may lie in the slot 76 and the handle leg 24 may be moved in either of directions 88, FIG. 2.

In FIG. 6 the orientation of screw 18 and handle latching assembly 16 is the same as shown in FIG. 2. In this orientation the blocks 38 and 40 of resilient material, FIG. 2, are resting uncompressed on the upper surface 44 of the lid 14. The threaded stud section 86 is partially engaged with the threaded hole 54 in the element 48, FIG. 2. The legs 24, 26, FIG. 5, may be moved in direction 88'' so that stud section 86 is placed in hole 74, FIG. 4, the threaded stud section 86 passing through slot 76 in this action.

To latch the lid 14 to the base 12, the screw 18 is rotated by hand clockwise in FIG. 6 and the screw 20 on the opposite side of the base 12 is rotated by hand in the opposite direction. This action tightens the screws further engaging studs 86 into the threaded holes of the corresponding elements 48. As the screws are continued to be rotated their conical surface sections 84 abut the chamfered edges 78 of the holes 72, FIG. 3, of legs 24 and 26. As the screws are further rotated and the stud sections 86 further engaged with the holes 54, the conical surface sections 84 of the screws 18 and 20 wedge against the edges 78 of the holes 72 forcing the legs 24 and 26 (not shown), FIG. 3, in direction 88'. In FIG. 3, the edge 78 of hole 72 and the surface of section 84 of the screw 18 (and of screw 20) are both inclined with respect to direction 100 in which the threaded stud 86 is being displaced along axis 56 and with respect to direction 88' in which it is desired to move the handle latching assembly 16 to tighten the assembly against the lid 14.

In FIG. 3 the inner surface 102 of leg 24 abuts the outer surface 104 of boss 52 of element 48. This precludes axial motion of the leg 24 relative to the lid 14 in the direction 100 parallel to axis 56. As the threaded stud section 86 moves in direction 100 the camming or wedging action of the conical surface section 84 against the surface 78 produces a component force in the direction 88'. This force displaces the leg 24 and portion 30, FIG. 2, in direction 88', compressing the block 40, FIG. 5. In essence, section 84 and surface 78 act as camming surfaces. This camming action tightly secures the lid 14 to the base 12. Lid 14 has a rectangular center portion 65 which projects beyond the plane of surface 66 to form a rigid side wall 62, FIG. 9, about the periphery thereof. The rectangular center portion is sized such that the wall 62 abuts the annular inner sides 70 of the base 12 also lying on a rectangular cylinder to prevent lateral movement of the lid with respect to the base 12 in any direction normal to directions 88. Thus, lid 14 is locked in all directions.

Loosening screws 18 and 20, FIG. 1, release the lid 14 without disassembling the handle latching assembly 16, FIGS. 8 and 9. When the stud sections 86 of the screws are sufficiently disengaged from the elements 48 so that the conical surface section 84 of the screws are beyond the legs 24 and 26, FIG. 5, the handle 34 may be lifted in the direction 88'' (FIG. 6) to the position of FIG. 7. The handle may then be rotated clockwise in direction 108, FIG. 7, until it is oriented as shown in FIGS. 8 and 9. With the handle rotated 90°, FIG. 8, from the position of FIG. 7, the screws 18 and 20 engage respective holes 74, FIG. 4. At this point the screws 18 and 20 are retightened to clamp the handle latching assembly 16 in place via chamfered edges 80 of holes 74. In this orientation, the system, in the case of a computer, can be rotated 90° to appear as shown in FIG. 9. In this orientation, handle 22 is adjacent to housing side wall 112.

An alternative orientation is shown in phantom in FIG. 9. In this orientation the handle 22 is rotated about its pivotal axis 56 in direction 113 until the respective edges 114 and 115 (FIG. 9), of portions 30 and 28, of the handle 22 are at rest against the base 12. In this orientation, handle 22 supports the base 12 during use of the instrument housed within base 12.

What is claimed is:

1. A lid latching apparatus comprising:

a housing having a threaded hole concentric about a first axis;

a lid member releasably secured to the housing;

a lid latching handle for locking the lid member to the housing and for carrying said housing and lid in one orientation of the handle, said handle including one leg portion that overlies the lid and engages the lid when moved to a locking position and a second leg portion generally normal to said one portion and positioned adjacent to a housing side, said second leg portion having an aperture with a conically tapered side wall, said aperture having a second axis parallel to the first axis, said one leg portion including means which normally offsets said second axis out of alignment with said first axis when the handle is unlocked; and a handle locking hand screw including a shaft passing through said aperture including a conical shoulder section engaged with said conically tapered side wall and a threaded stud section concentric with said shoulder in engagement with said threaded hole, said second leg portion being between said shoulder and housing, said shoulder when moved parallel to said first axis by further engagement of said stud section in said hole tending to align the axes placing said one leg portion in said lid locking position, whereby wedging the handle in place and securing the lid member to the housing.

2. The apparatus of claim 1 wherein the means which normally offsets said second axis includes a resilient member attached to the one leg portion between the one leg portion and the lid member, said screw rotating in said threaded hole about said first axis, said one leg portion being spaced from said first axis so that said resilient member is compressed between said one leg portion and the lid member when said conical shoulder engages said conical side wall in said locking position and uncompressed when said shoulder disengages said side wall in said unlocked position.

3. The apparatus of claim 1 wherein said second leg portion includes a second aperture having a second conical side wall and a slot in communication with both said apertures, said screw being dimensioned such that the threaded stud can slide in said slot from one aperature to the other.

4. The apparatus of claim 1 further including third and fourth leg portions like said one and second leg portions, respectively, and a second like screw on a side of the housing opposite said housing side, the axes of said threaded holes being coaxial, and resilient means between the third leg portions and said lid and attached to said third leg portion, said fourth leg portion holes and apertures being spaced such that said resilient means compresses in response to the engagement of said shoulder of said second screw with said conically tapered side walls to said locking position.

5. A latching apparatus comprising:

a first member;

a second member; and a latching assembly for securing the first member to the second member, said assembly having latched and unlatched states, said assembly comprising a link member adapted to engage and lock to the first member when the link is displaced in a first direction to a latch position, said link member having an aperture, said aperture having a conical edge surface which is inclined with respect to said first direction and to a second direction, a threaded latch actuating member having a conical camming surface which abuts said conical edge surface, thread means secured to the second member for movably receiving and securing the actuating member in said second direction, said second member and said link member including abutment means for precluding relative displacement therebetween in said second direction to thereby clamp the link member between said actuating member camming surface and said second member abutment means, said link member tending to displace in said first direction in response to displacement of said actuating member camming surface against said inclined surface in said second direction to thereby place the assembly in the clamped and latched state.

6. The apparatus of claim 5 wherein said means for movably receiving and securing includes a threaded aperture in said second member and a mating threaded stud section on said actuating member engaged with said aperture threads.

7. The apparatus of claim 5 wherein said link member includes first and second holes and a slot in communication with the holes, each a frusto-conical surface for engagement with said camming surface for placing the link member in different latch positions.

8. A latching apparatus comprising:

a first member;

a second member; and a latching assembly for securing the first member to the second member, said assembly having latched and unlatched states, said assembly comprising a link member adapted to engage and lock to the first member when the link is displaced in a first direction to a latch position, said link member having an aperture, said aperture having a conical edge surface which is inclined with respect to said first direction and to a second direction, a threaded latch actuating member having a conical camming surface which abuts said conical edge surface, thread means secured to the second member for movably receiving and securing the actuating member in said second direction, said second member and said link member including means for precluding relative displacement therebetween in said second direction, said link member tending to displace in said first direction in response to displacement of said actuating member camming surface against said inclined surface in said second direction to thereby place the assembly in the latched state, said link member including first and second holes and a slot in communication with the holes, each hole having a frusto-conical surface for engagement with said camming surface for placing the link member in different latch positions.

* * * * *

UNITED STATES PATENT AND TRADEMARK OFFICE
CERTIFICATE OF CORRECTION

PATENT NO. : 4,476,994

DATED : October 16, 1984

INVENTOR(S) : George P. Hope et al.

It is certified that error appears in the above-identified patent and that said Letters Patent is hereby corrected as shown below:

Column 1, line 21, "repsect" should be --respect--.

Column 1, line 27, "diassembled" should be --disassembled--.

Column 3, line 43, "occures" should be --occurs--.

Column 5, line 25, "whereby" should be --thereby--.

Column 5, lines 42-43, "aperature" should be --aperture--.

Column 6, line 29, after "each" insert --hole having a--.

Signed and Sealed this

*Thirtieth* Day of *July 1985*

[SEAL]

*Attest:*

DONALD J. QUIGG

*Attesting Officer* *Acting Commissioner of Patents and Trademarks*